United States Patent [19]

Jenkins et al.

[11] Patent Number: 4,944,157

[45] Date of Patent: Jul. 31, 1990

[54] REFRIGERATOR FREEZER COMPARTMENT FLOOR COVERING ASSEMBLY

[75] Inventors: Thomas E. Jenkins; David G. Beers, both of Louisville, Ky.

[73] Assignee: General Electric Company, Louisville, Ky.

[21] Appl. No.: 376,436

[22] Filed: Jul. 7, 1989

[51] Int. Cl.[5] ..... F25D 17/04

[52] U.S. Cl. ..... 62/407; 62/440; 62/465

[58] Field of Search ..... 62/407, 408, 440, 465; 312/214, 292, 328

[56] References Cited

U.S. PATENT DOCUMENTS

| | | | |
|---|---|---|---|
| 2,302,385 | 11/1942 | Anderson | 62/89 |
| 2,565,129 | 8/1951 | Hermani | 312/328 |
| 2,787,132 | 4/1957 | Scott | 62/465 X |
| 3,638,449 | 2/1972 | Lichtenberger | 62/407 X |
| 3,726,578 | 4/1973 | Armstrong | 312/214 |
| 4,306,757 | 12/1981 | Horvay et al. | 312/292 |
| 4,592,209 | 6/1986 | Casanova et al. | 62/255 |
| 4,603,557 | 8/1986 | Halbmann | 62/255 |

*Primary Examiner*—Lloyd L. King

*Attorney, Agent, or Firm*—Radford M. Reams; H. Neil Houser

[57] ABSTRACT

A household refrigerator having a freezer compartment with a rear wall, top wall, side walls, bottom wall and an open front. An evaporator unit is mounted in a space in front of the rear wall of the freezer compartment and there is a vertical panel separating the evaporator unit from the rest of the freezer compartment to form an evaporator compartment between the panel and rear wall. The bottom wall of the freezer compartment has a plurality of upwardly open grooves extending from the front section of the freezer compartment under the vertical panel and into the evaporator compartment. A cover is hingedly connected to the panel for movement to a raised position above the bottom wall for access to the grooves in the bottom wall for cleaning and to a lowered position horizontal to the bottom wall to provide a flat level shelf area for storage items in the freezer compartment.

4 Claims, 2 Drawing Sheets

REFRIGERATOR FREEZER COMPARTMENT FLOOR COVERING ASSEMBLY

BACKGROUND OF THE INVENTION

This invention relates to a household refrigerator freezer compartment floor cover assembly.

In household refrigerators wherein a freezer compartment is located at the top of the refrigerator cabinet There is usually at the rear of the freezer compartment an evaporator and fan assembly for lowering the temperature in the freezer compartment and also the underlying fresh food compartment. As in any refrigeration system it is desirable to have an air flow system that will circulate air from the evaporator coils into the respective compartments and return the air to the evaporator coils for recooling and recirculation to the compartments to be cooled. In the freezer compartment it has been found desirable for good air flow characteristics to have horizontal grooves in the floor of the compartment extending from the front of the freezer compartment to the rear where the evaporator coils are located. In using the freezer compartment for storing food items, on occasion the items or food containers will become lodged in the grooves and hinder and sometimes prevent the flow of air from the front of the freezer compartment through the grooves to the evaporator coil area. It is desirable to provide a flat level shelf area for storage of the food items and food containers in the freezer compartment without blocking air flow through the grooves in the floor yet be able to have access to the grooves for cleaning purposes in the event that food product is spilled in the horizontal grooves or for general sanitary cleaning in this area.

By this invention there is provided a freezer compartment cover assembly which will provide a flat level surface for storage of the food items and food containers in the freezer compartment and allow access by the user to the underlying grooves for cleaning purposes.

SUMMARY OF THE INVENTION

There is provided a refrigerator assembly having a freezer compartment with a rear wall, top wall, side walls, bottom wall and an open front. An evaporator unit is mounted in a space in front of the rear wall of the freezer compartment and there is a vertical panel separating the evaporator unit from the rest of the freezer compartment to form an evaporator compartment between the panel and rear wall. The bottom wall of the freezer compartment is provided with a plurality of upwardly open grooves extending from the front section of the freezer compartment under the vertical panel and into the evaporator compartment. A cover is hingedly connected to the panel for movement to a raised position above the bottom wall for access to the grooves in the bottom wall for cleaning purposes and to a lowered position horizontal to the bottom wall to provide a flat level surface for storage of food items and food containers in the freezer compartment.

DESCRIPTION OF THE PREFERRED EMBODIMENT

Figure 1:
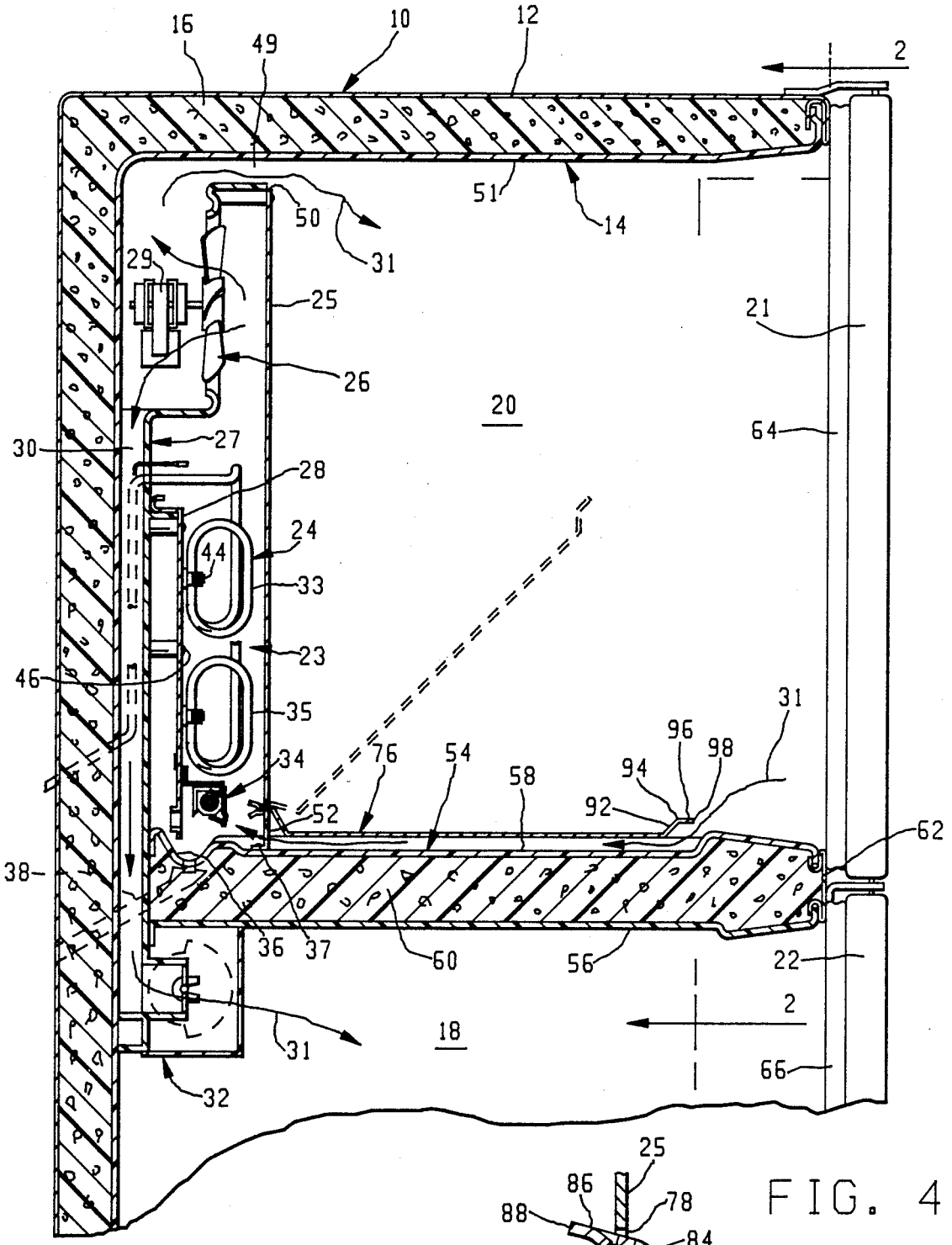
FIG. 1 is a side elevational view in cross section of a household refrigerator including one form of the present invention.
Figure 2:
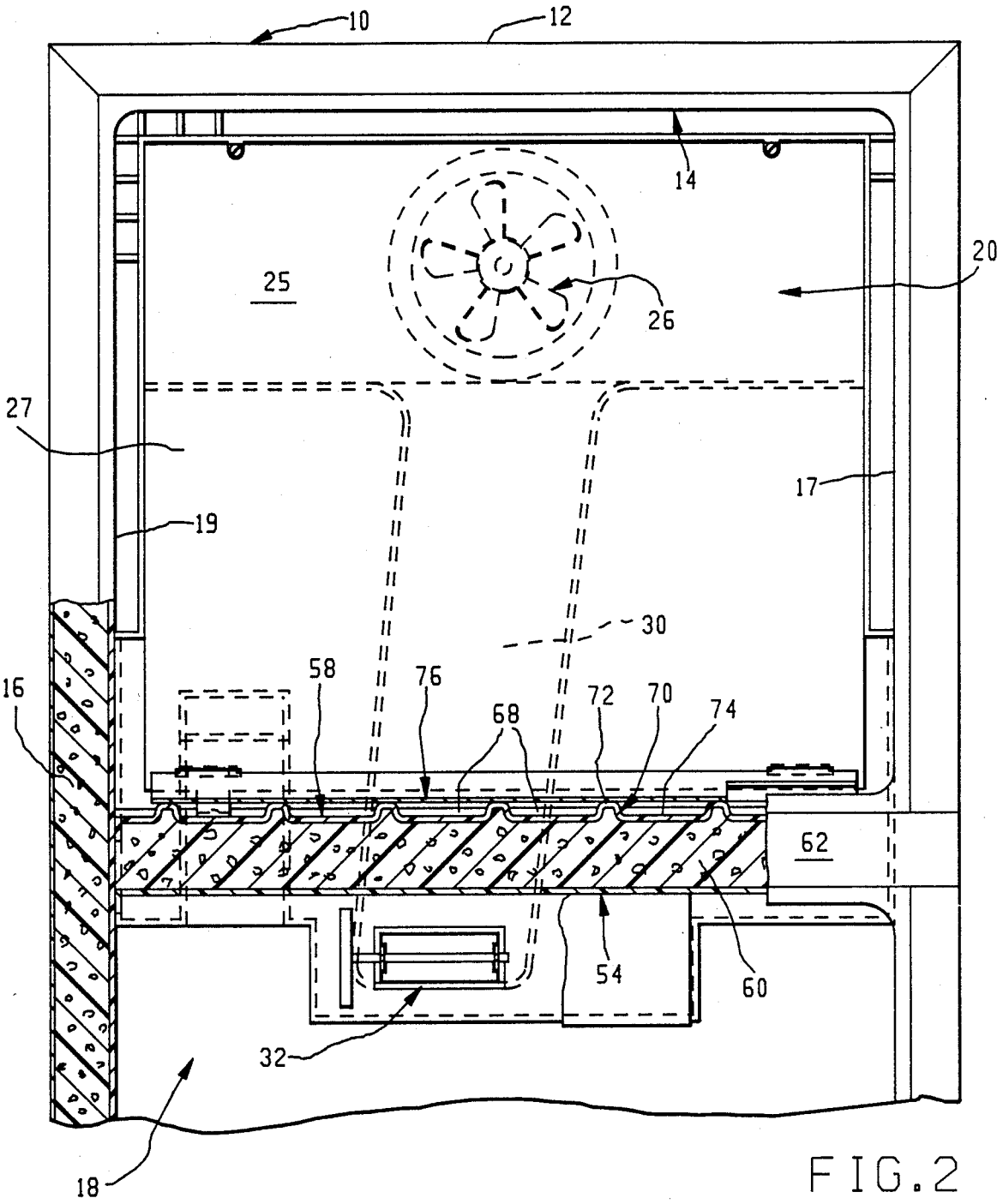
FIG. 2 is a front elevational view in cross section of the household refrigerator of FIG. 1 taken along line 2—2.

With reference particularly to FIGS. 1 and 2, there is shown a refrigerator cabinet 10 which includes an outer shell 12 and an inner liner 14 spaced from the outer wall. The space between the outer shell and inner liner is filled with thermal insulation 16 in a conventional manner.

Formed within the interior of the refrigerator cabinet are a first compartment 18 positioned in the bottom portion of the cabinet and a second compartment 20 positioned in the bottom portion of the cabinet. Compartment 18 is to be maintained at a temperature above freezing for the storage of fresh food and compartment 20 is to be maintained at a temperature below freezing for the storage of frozen foods. There is an access door 21 for freezer compartment 20 and an access door 22 for fresh food compartment 18. The freezer compartment 20 has a rear wall 27, a top wall 51, a bottom wall 58, and side walls 17 and 19. At the rear of the freezer compartment 20 there is an evaporator compartment 23 for housing the evaporator 24 with a vertical panel 25 separating the evaporator compartment 23 from the rest of the freezer compartment 20. The rear wall 27 of the freezer compartment is also the main support panel on which the evaporator 24 and fan 26 are mounted. The fan 26 is driven by a motor 29 which will cause air to flow in both the freezer compartment 20 and the fresh food compartment 18. A portion of the air is diverted downwardly through duct 30 to the control damper 32 and out into the fresh food compartment 18 for cooling that compartment. The general pattern of air flow through the compartments is shown by arrows designated 31. The evaporator 24 is a helically coiled tubular elongated member which in the preferred embodiment is shown as having a top horizontal helical coil section 33 and a bottom helically coiled horizontal section 35 spaced a small distance below the top section 33. The evaporator 24 as shown in FIG. 1 has the top coil section 33 and bottom coil section 35 secured to a plate or structural panel member 28 as by clamp devices 44. The evaporator 24 is secured to the structural panel member 28 as a sub-assembly during the manufacture of the refrigerator and then is subsequently installed in the evaporator compartment by screw fasteners 46 which are secured through the structural panel member 28 into the rear wall 27 of the freezer compartment which acts as the main support for the evaporator unit.

Below the evaporator 24 is a defrost heater assembly 34 which runs parallel to the bottom coil section 35 and will defrost the evaporator at timed intervals. In front of the evaporator 24 is a vertical panel 48 which separates the evaporator compartment 23 from the rest of the freezer compartment 20. Thus, the evaporator compartment 23 is formed by the panel 48 and rear wall 27 and the sides of the freezer compartment. The panel 48 is usually made from sheet metal and it is suitably fastened at the top to the rear wall 27. There is a space 49 between the top edge 50 and the top wall 51 of the freezer compartment formed by the liner 14 to provide an air passage leading from the evaporator compartment 23 into the forward portion of the freezer compartment 20 as shown by air flow arrow designated 31. The purpose of the vertical panel 48 is to prevent food items and containers stored in the freezer from coming into contact with the evaporator unit and fan 26 which could detrimentally affect their operation. The bottom edge 52 of vertical panel 48 is attached to the mullion partition 54 by a small flange element 37 formed in the panel 48 and a screw fastener 39 through the flange element into bottom wall 58. The mullion 54 consists of a bottom panel 56 which acts as the ceiling or top wall of the fresh food compartment 18 and a top panel which is the bottom wall 58 of the freezer compartment and between the bottom panel 56 and bottom wall 58 is thermal insulation 60 to insulate the freezer compartment from the fresh food compartment. The rear of the bottom wall 58 has formed therein a drain trough 36 into which defrost condensate is deposited and removed from the interior of the refrigerator by a conduit 38. The mullion 54 has at the front of the refrigerator a mullion strip 62 which extends from one side of the refrigerator cabinet to the other and against which the access doors 21 and 22 seal as by magnetic gaskets 64 and 66 respectively.

Figure 3:
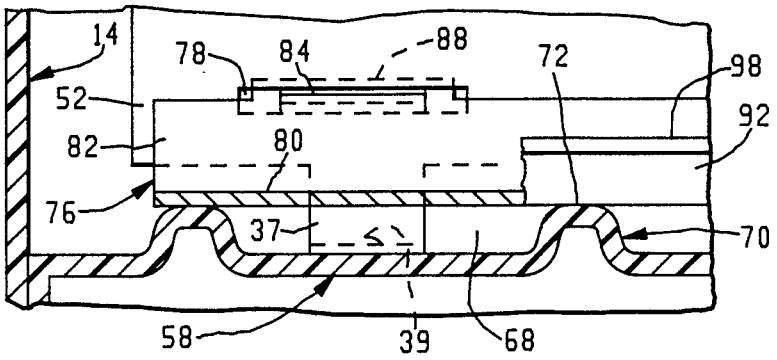
FIG. 3 is an enlarged view of a portion of the household refrigerator of FIG. 2 showing details of the present invention.

With reference particularly to FIGS. 2 and 3, the bottom wall 58 of the freezer compartment 20 is one of the components of the mullion 54 and is usually molded from suitable plastic material. In accordance with this invention the bottom wall 58 has a plurality of upwardly open grooves 68 which are in the form of parallel channels that extend from the front section of the freezer compartment 20 under the vertical panel 25 as shown in FIG. 1. The grooves 68 are separated from each other by upstanding ribs 70 which also extend from the front section of the freezer compartment under the vertical panel 25 and into the evaporator compartment 23. As shown in the preferred embodiment the top of the ribs 70 have flat sections 72. The grooves 68 are to provide air passageways from the front section of the freezer compartment 20 back into the evaporator compartment 23 so that the air will be recooled by the evaporator and then recirculated into the freezer and fresh food compartment by the fan.

Freezer compartments for household refrigerator are used for storing foods at below freezing temperatures and usually consist of packages of frozen vegetables, meat, ice cream and other frozen food kept in various kinds of containers. One of the difficulties with providing grooves 68 in the bottom wall 58 of the freezer compartment 20 is that these food items are often stored in such a manner that they do not just rest on the flat section 72 of the rib 70 but may rest on the bottom section 74 of the grooves and block the air passageways from the front of the freezer to the evaporator compartment. To prevent this air flow blockage there is provided a cover 76 which is flat and level and extends substantially the width of the freezer compartment. The cover is dimensioned to rest on the flat section 72 of the upstanding ribs 70 as shown in FIGS. 2 and 3 particularly. While a cover such as cover 76 will prevent the food items from blocking the air flow through the grooves 68, there needs to be provided an arrangement whereby the user of the refrigerator may occasionally clean the grooves 68 as it becomes necessary due to spillage or for other sanitary reasons. It is therefore desirable to have the cover 76 capable of being raised to allow access for cleaning the grooves 68 and lowered to the position shown in FIG. 2 for storage of food items on top of the cover. It is desirable that the cover have both of these features and therefore should not be easily removable and discarded by the user which would then result in the food items being placed in the freezer compartment falling into the groove 68 and blocking the air flow passageways.

Figure 4:
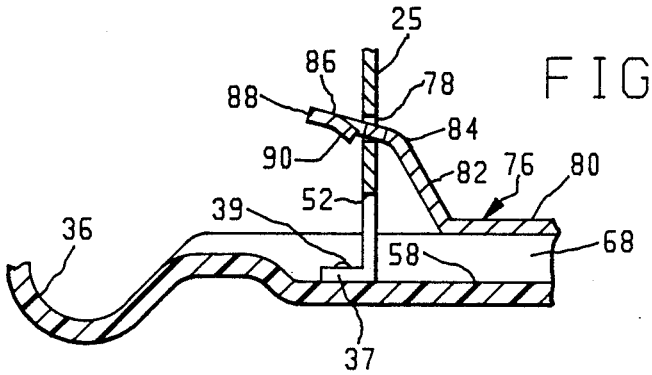
FIG. 4 is a side elevational view in cross section showing details of the present invention.

In the preferred embodiment the cover 76 is hingedly attached to the vertical panel 25 separating the evaporator compartment 23 from the front of the freezer compartment 20. The arrangement of the hinge 77 is particularly shown in FIGS. 3 and 4. Both the vertical panel 25 and the cover 76 are made from sheet metal and are formed so that the vertical panel 25 has two horizontal slots 78 which are elongated rectangular shaped and horizontally disposed with one slot 78 being located near one side wall of the freezer compartment and the other slot near the other side wall of the freezer compartment. The cover 76 has a flat base 80 and near the rear thereof there is an upwardly inclined section 82 then a bend area 84 and then a tab 86 slightly inclined from the horizontal plane and having a terminal end 88. The length of the tab 86 is slightly less than the length of the slot 78 so that the tab may be inserted through the slot as shown particularly in FIG. 4. The tab 86 has a downwardly directed or offset tang 90 which may be deflected toward the plane of tab 86 as it is being inserted through the slot 78 and once the tang 90 is past the slot the tang being biased by the bending action will deflect downwardly away from the plane of tab 86 and prevent withdrawal of the tab 86 from the slot 78. This kind of arrangement is for both of the hinges 77 that will hold the cover 76 in hinged attachment to the vertical panel 25. As seen in FIG. 1 in solid line, the cover 76 is in a lowered position horizontal to the bottom wall 58 and as shown in phantom line the cover 76 may be raised a sufficient distance from the bottom wall 58 so that the user has access to the grooves 68 when the cover is in its raised position. At the front of the cover 76 there is an upwardly inclined section 92, then a bend 94 and then a horizontal flange 96 having a terminal end 98. It will be noted as shown in FIG. 1 that the upwardly inclined section 92 and the flange 96 are spaced from the front of the grooves 68 to allow air to flow into the grooves as shown by the arrow 31. The bottom edge 52 of the vertical panel 48 is attached to the mullion partition 54 such that there is space between the panel and the rear of the grooves 68 to allow air to flow from the grooves into the evaporator compartment 23.

With the structural arrangement described above, the two desirable features mentioned previously are achieved. That is, a cover assembly is provided to rest on top of the ridges 70 to prevent food items from blocking the air flow through the grooves 68 when the cover is in its lowered position and to allow access for cleaning the grooves when raised to an upper position. To raise the cover 76 the user may grip the flange 96 and merely raise the cover after removal of the food items in the freezer compartment that are stored on top of the cover. It will be noted that with the hinge arrangement shown and described, it is not easy for the user to remove the cover from within the freezer compartment which would prevent the functioning of the cover as a shield to prevent blockage of the grooves by food items stored in the freezer compartment 20. Therefore, the cover will be always in place to provide that feature, yet the grooves are accessible for cleaning by raising the cover.

While, in accordance with the Patent Statutes, there has been described what at present is considered to be the preferred embodiment of the invention, it will be obvious to those skilled in the art that various changes and modifications may be made thereto without departing from the invention. It is, therefore, intended by the appended claims to cover all such changes and modifications as fall within the true spirit and scope of the invention.

What is claimed is:

1. A refrigerator assembly comprising:

a freezer compartment having a rear wall, top wall, side walls, bottom wall and an open front, an evaporator unit mounted in a space in front of the rear wall, a vertical panel separating the evaporator unit from the rest of the freezer compartment to form an evaporator compartment between the panel and rear wall, a plurality of upwardly open grooves in the bottom wall of the freezer compartment extending from the front section of the freezer compartment under the vertical panel and into the evaporator compartment, and a cover hingedly connected to the panel for movement to a raised position above the bottom wall for access to the grooves in the bottom wall and to a lowered position horizontal to the bottom wall.

2. The refrigerator of claim 1 wherein the cover has a raised front terminal end for gripping and raising the cover to its raised position.

3. The refrigerator assembly of claim 1 wherein the front of the cover and the portion of the grooves at the front of the freezer compartment are spaced from each other when the cover is in its lowered position to provide an air flow passage therebetween.

4. The refrigerator assembly of claim 1 wherein the rear of the cover has two raised spaced tabs inserted through two spaced slots in the panel with the spaced inserted tabs being hingedly retained in the slots by offset tangs in each of the tabs to prevent withdrawal of the tabs from the slots.

* * * * *